US006385803B1

(12) United States Patent
Viard

(10) Patent No.: US 6,385,803 B1
(45) **Date of Patent: *May 14, 2002**

(54) METHOD AND APPARATUS FOR SUPPORTING AN ELEMENT TO BE SUPPORT, IN PARTICULAR THE BODY OF A PATIENT, THE APPARATUS HAVING A SUPPORT DEVICE INDEPENDENT FROM THE CONTROL DEVICE

(75) Inventor: Jean-Louis Viard, Grabels (FR)

(73) Assignee: Hill-Rom Industries S.A., Montpellier (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,579

(22) Filed: May 22, 2000

Related U.S. Application Data

(63) Continuation of application No. 08/995,669, filed on Dec. 22, 1997, now Pat. No. 6,079,068.

(30) Foreign Application Priority Data

Dec. 23, 1996 (FR) ..... 96 15849

(51) Int. Cl.[7] ..... A47C 27/08

(52) U.S. Cl. ..... 5/671; 5/672; 5/665; 5/713

(58) Field of Search ..... 5/665, 671, 672, 5/673, 676, 679, 685, 686, 687, 710, 713, 715, 738

(56) References Cited

U.S. PATENT DOCUMENTS

| | | | | |
|---|---|---|---|---|
| 4,435,864 A | | 3/1984 | Callaway | |
| 4,797,962 A | | 1/1989 | Goode | |
| 4,833,457 A | | 5/1989 | Graebe, Jr. | |
| 4,873,737 A | | 10/1989 | Savenije | |
| 4,949,412 A | | 8/1990 | Goode | |
| 5,020,176 A | | 6/1991 | Dotson | |
| 5,560,374 A | | 10/1996 | Viard | |
| 5,850,644 A | | 12/1998 | Hsia | |
| 5,934,280 A | | 8/1999 | Viard et al. | |
| 6,009,580 A | | 1/2000 | Caminade et al. | |
| 6,079,068 A | * | 6/2000 | Viard | 5/671 |
| 6,094,762 A | * | 8/2000 | Viard et al. | 5/713 |
| 6,154,907 A | * | 12/2000 | Cinquin | 5/713 |

FOREIGN PATENT DOCUMENTS

| | | |
|---|---|---|
| DE | 94 11 493 | 11/1994 |
| EP | 0 218 301 | 4/1987 |
| EP | 0 676 158 | 10/1995 |

* cited by examiner

*Primary Examiner*—Robert G. Santos
(74) *Attorney, Agent, or Firm*—Wolf, Greenfield & Sacks, P.C.

(57) ABSTRACT

The invention relates to a method and apparatus for supporting an element to be supported, in particular the body of a patient. The apparatus comprises a support device 20 essentially comprising only at least one closed or controlled-release chamber 21 together with inlet and outlet means 26 via which the filling fluid can be fed in or removed, and an independent control device 40 is provided disposed under the support device 20, said control device 40 comprising filling and emptying means for filling the chamber with filling fluid or for emptying said fluid therefrom and the control means proper 50, 41, 42 for controlling feeding in and removing the filling fluid. The invention makes it possible to simplify manufacture and management of a support for supporting an element to be supported such as the body of a patient.

24 Claims, 1 Drawing Sheet

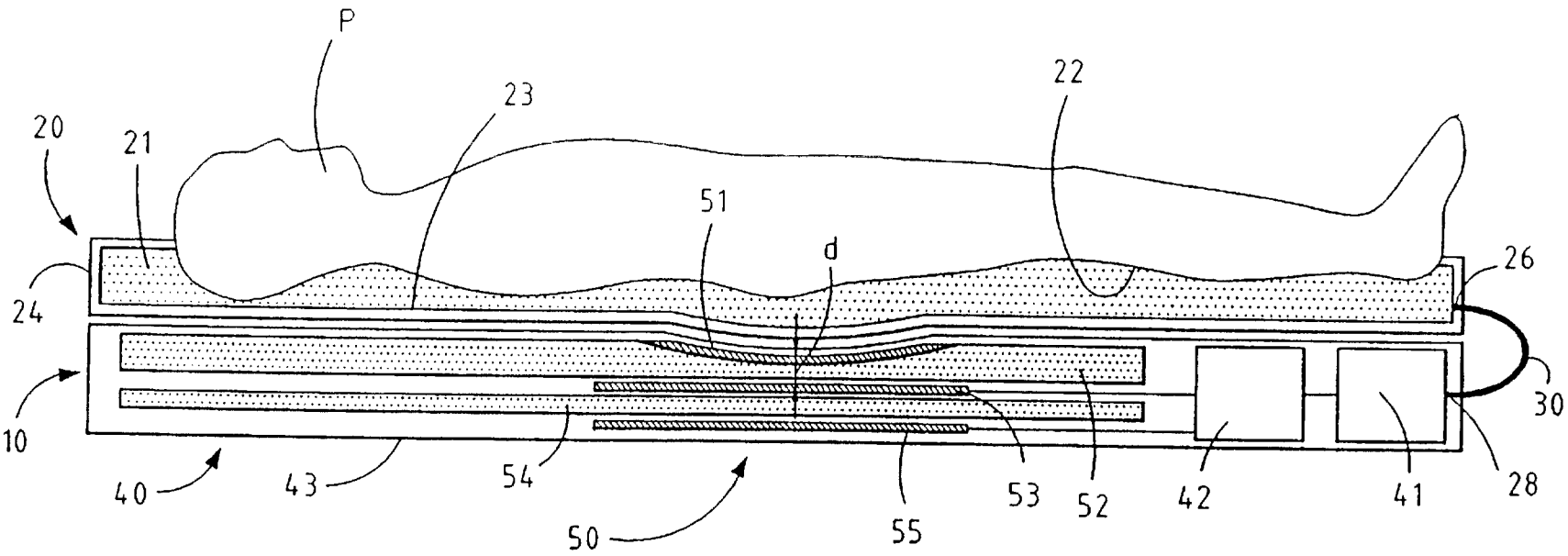
26
30
28
41
42
22
52
53
55
d
51
50
54
23
P
43
40
21
20
24
10

METHOD AND APPARATUS FOR SUPPORTING AN ELEMENT TO BE SUPPORT, IN PARTICULAR THE BODY OF A PATIENT, THE APPARATUS HAVING A SUPPORT DEVICE INDEPENDENT FROM THE CONTROL DEVICE

This application is a continuation of Ser. No. 08/995,669 filed Dec. 22, 1997 now U.S. Pat. No. 6,079,068.

The invention relates to a method and apparatus for supporting an element to be supported, in particular the body of a patient, the apparatus having a support device proper and a monitoring or control device that is independent from and physically separate from the support device. The invention may be particularly advantageously applied to preventing and treating complications related to long periods of being confined to bed and of being kept still, in particular bedsores.

BACKGROUND OF THE INVENTION

The prior art, and in particular the Applicant's prior document FR-A-2 718 347=EP-A-676 158, which corresponds to U.S. Pat. No. 5,560,374, discloses a method and a device for supporting an element to be supported, in particular the body of a patient, making it possible to support the element at an essentially constant controlled penetration depth.

In the Applicant's prior document, a measurement device is provided comprising a first element that is integrated in the support device, which complicates the manufacturing technology and exposes the integrated element to any damage that is inflicted to the support element itself.

Furthermore, the monitoring or control means are disposed externally which increases the overall size of the device, and gives rise to coupling and installation difficulties.

In addition, that prior device suffers from the drawback that technical elements are integrated with the therapeutic surface, which increases the difficulty of managing the therapeutic surface, in particular as regards interchangeability.

To reduce the overall size and to simplify implementation and management, it has been proposed, in Document U.S. Pat. No. 5,325,551 to integrate the monitoring and control devices inside the mattress unit itself.

Unfortunately, that solution does not solve the problem of making the technical elements independent from the mattress unit, this problem being addressed for the first time by the inventors.

OBJECTS AND SUMMARY OF THE INVENTION

Therefore, an object of the present invention is to solve the new technical problem comprising providing a solution making it possible to dissociate fully the monitoring and control means from the support means, and in particular from the mattress constituting the therapeutic prevention and treatment surface when the body of a patient is to be supported.

Another main object of the present invention is to solve the new technical problem consisting in providing a solution making it possible to simplify the manufacturing technology of the support element, in particular of a mattress when the body of a patient is to be supported, and to make it independent from the monitoring or control technology for monitoring or controlling the support element, while retaining a structure that is simple with as few connections as possible, and in particular by making it impossible for such connections to be accidentally accessible or damageable.

Another object of the present invention is to solve the new technical problem consisting in providing a solution that makes it easy to replace the support element, in particular a mattress, when it is damaged or contaminated, without significantly affecting the monitoring and/or control means.

All of these technical problems are solved for the first time by the present invention in a manner that is simple, cheap, safe, and reliable, that is easy to implement, and that can be used industrially and medically.

Thus, in a first aspect, the present invention provides a method of supporting an element to be supported, in particular the body of a patient, the method consisting in providing at least one support device comprising at least one closed or controlled-release flexible chamber, in providing filling and emptying means for filling said chamber with a filling fluid and emptying said fluid from said chamber, and in providing control means for controlling the filling and emptying means, wherein said support device essentially comprises only said at least one closed or controlled-release chamber, together with inlet and outlet means via which said filling fluid can be fed in or removed, and wherein an independent control device is provided disposed under the support device, said control device comprising the filling and emptying means for filling the chamber with the filling fluid or for emptying said fluid therefrom, together with the control means proper for controlling feeding in or removing the filling fluid.

In an advantageous implementation, the independent control device further comprises measurement means for measuring the penetration distance to which the element to be supported penetrates into the chamber of the support device, the independent control means comprising servo-control means for servo-controlling the filling and emptying means present in said independent control device so as to servo-control feeding the filling fluid into said chamber of the support element and removing said fluid therefrom at least as a function of the measured penetration distance.

In another implementation, the measurement device present in the independent control device delivers information mirroring the extent to which the element to be supported penetrates into the support device, and it comprises a metal film associated with a spacer element of thickness that is predetermined and compressible as a function of the penetration distance to which the element to be supported penetrates into the chamber of the support device, said metal film co-operating with an impedance-varying element whose position is fixed and substantially opposite from said metal film, in particular under the bottom surface of the spacer element of variable thickness, an electric signal thus being generated as a function of the penetration distance to which the element to be supported penetrates into the support device, which signal is transmitted to the control system.

In another implementation, the spacer element of variable thickness is itself disposed on a spacer element of fixed thickness.

In another implementation of the invention, a shielding element, in particular a shielding induction coil, is provided disposed on that face of the spacer element of fixed thickness which is further from the above-mentioned impedance-varying element interposed between the spacer element of variable thickness and said spacer element of fixed thickness.

In a particularly advantageous other implementation of the invention, the above-mentioned support device is incorporated in an individual cover, the independent control device itself being incorporated in a second independent individual cover, the support device and the independent control device comprising coupling means enabling the control device to cause the filling fluid to be fed into the chamber of the support device or to be removed therefrom.

In another implementation of the invention, the control device takes up an area that is not larger than the area serving to receive the support device.

In another implementation of the invention, the element to be supported is constituted by the body of a patient, and the support element is constituted by a mattress comprising one or more closed or controlled-release flexible chambers as mentioned above, said mattress constituting the prevention or treatment surface, and the independent control device comprising all of the monitoring means and all of the control means for monitoring and controlling the therapeutic surface.

In a second aspect, the present invention relates to apparatus for supporting an element to be supported, in particular the body of a patient, the apparatus comprising: at least one support device comprising at least one closed or controlled-release flexible chamber; inlet and outlet means via which a filling fluid can be fed into said chamber or removed therefrom; and control means for controlling the filling and emptying means; wherein the support device essentially comprises only said at least one closed or controlled-release chamber, the support apparatus further comprising an independent control device disposed under the support device, said control device comprising the filling and emptying means for filling the chamber with the filling fluid or for emptying said fluid therefrom together with the control means proper for controlling feeding in and removing the filling fluid.

Various advantageous embodiments of the apparatus result clearly from the advantageous implementations of the method described above, and they may also result from the following description taken as a whole and incorporating the drawing.

It can thus be understood that the present invention makes it possible to solve the above-mentioned new technical problem well. In the context of the invention, when the support element is damaged or contaminated, such a support element being in particular a mattress, which is conventional when supporting patients confined to bed or kept still for prolonged periods of time, and in particular when treating such patients, the invention makes ideal interchangeability possible because the support element or the mattress is independent, of construction that is simple and cheap, and it contains no technical element. Furthermore, the support element, in particular a mattress, serves as a sort of protective surface for protecting the independent control device which is itself also protected by an individual protective cover.

It can thus be understood that the invention offers a decisive technical improvement making it possible to lower the manufacturing cost and above all the operating cost, this being a major concern when managing equipment, in particular in hospitals. Furthermore, the invention is very versatile because it can be adapted to suit any support device structure, in particular a mattress, and especially a mattress having a single chamber or a mattress having multiple chambers regardless of whether the chambers communicate with one another, and to suit surfaces whose operating modes are different, in particular single-chamber or multi-chamber support surfaces having continuous operating modes, and surfaces having modes involving alternating pressures, or rotating, pulsating, or percussive pressures, without this being limiting.

Other objects, characteristics, and advantages of the invention appear clearly on reading the following explanatory description made with reference to a currently-preferred embodiment of the invention given merely by way of illustration, and therefore in no way limiting the scope of the invention. It should be noted that any characteristic that appears to be novel compared with any prior art on the basis of the description taken as a whole and incorporating the drawing is an integral part of the present invention and of the present description.

BRIEF DESCRIPTION OF THE DRAWING

In the drawing, the sole FIGURE is a longitudinal section view through support apparatus of the present invention comprising a support device itself comprising a support device proper and an independent control device in a currently-preferred embodiment of the present invention.

MORE DETAILED DESCRIPTION

The sole FIGURE shows apparatus of the invention under the overall reference 10. This support apparatus 10 comprises a support device proper given overall reference 20 and comprising at least one closed or controlled-release flexible chamber 21 and having a top face 22 and a bottom face 23, said chamber being enclosed in an individual protective cover 24. The chamber 21 is provided with interconnection means 26 connected by connector means given overall reference 30 to corresponding interconnection means 28 integrated in an independent control device that is given overall reference 40 and that is described below.

The independent control device 40 is advantageously provided with an individual protective cover 43 containing the monitoring and control members 50, 41, and 42 that are described below.

In a currently-preferred embodiment, the monitoring member 50 comprises measurement means for measuring information mirroring the extent to which an element to be supported, in particular the body of a patient P, penetrates into the chamber 21 of the support device 20. The measurement means advantageously comprise a metal film 51 associated, in this example, with the top surface of a spacer element 52 of variable thickness reacting to the penetration of the body of the patient P into the chamber 21 of the support element 20, and co-operating with an impedance-varying element 53 disposed under the opposite surface of the spacer element 52 of variable thickness. In the embodiment shown, the impedance-varying element 53 is itself disposed on the top face of a spacing element 54 of fixed thickness. In the preferred embodiment shown in the accompanying sole FIGURE, the opposite face of the spacing element 54 of fixed thickness is provided with a shielding element, preferably constituted by a shielding induction coil 55 disposed at a predetermined distance from the measurement element 53, which is achieved by the presence of the rigid spacing element 54, so as to prevent any influence from a metal mass situated under the measurement device or in the vicinity thereof, which is generally the case at least for the frame of the apparatus.

The impedance-varying element 53 and the shielding element 55 are electrically connected to a control station 42 which drives the means 41 for filling the chamber 21 of the support device with filling fluid or for emptying said fluid from said chamber.

The spacer element 52 of variable thickness may be implemented in various ways. It may merely be a bladder that can be inflated with a fluid such as air or water, or it may be an element made of compressible foam of suitable density. Other variant embodiments of the spacer element 52 of variable thickness can naturally be implemented by a person skilled in the art.

The control member 50, 41, 42 naturally comprises the filling means and emptying means proper for filling the chamber 21 of the support element 20 with filling fluid and for emptying said fluid from said chamber. Such filling means and emptying means are well known to a person skilled in the art, the filling means comprising, for example, pumping means such as an air or water pump or turbine, and the emptying means generally comprising a valve connected to the atmosphere and controlled selectively by the control station 42.

It can be understood that construction, operation, and management of the apparatus are particularly simple as a result of the simplified and interchangeable design of the support element (preferably a mattress for supporting a patient) which can be changed very simply merely by disconnecting the filling or emptying connections 30, and this simplicity also applies to the independent control device. When the control device breaks down, it is also possible to replace it without having to remove the patient from the support element (in particular a mattress).

It can thus be understood that the invention makes it possible to achieve decisive technical improvements reducing the manufacturing and operating costs.

The invention also covers any means constituting technical equivalents of the means described, and the various combinations thereof. Furthermore, the sole FIGURE is an integral part of the present invention, and thus of the present description.

What is claimed is:

1. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body element and thereby defining the penetration distance into said at least one support device by said body element;

measuring said penetration distance with said measuring means of said control device; and driving the filling and emptying of said at least one chamber with said filling fluid by said filling and emptying means via said inlet and outlet means, respectively, based on regulation from said control device including said control station at least as a function of the measured penetration distance.

2. The method of claim 1, wherein said step of penetrating said at least one chamber by said body element comprises the step of horizontally positioning the patient on said top face of the support device which comprises a prevention or treatment surface.

3. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body element and thereby defining the penetration distance into said at least one support device by said body element;

measuring said penetration distance with said measuring means of said control device;

driving the filling and emptying of said at least one chamber with said filling fluid by said filling and emptying means via said inlet and outlet means, respectively, based on regulation from said control device including said control station at least as a function of the measured penetration distance;

incorporating the support device into an individual support cover;

incorporating the entire independent control device as one unit into a second independent individual control cover; and coupling the independent control device in the second independent control cover to the support device in the individual support cover via coupling means enabling the control device to cause the filling and emptying means in the independent control device to fill or remove fluid via the inlet and outlet means of said flexible chamber of said support device to cause the filling fluid to be fed into the chamber of the support device or to be removed therefrom.

4. The method of claim 3, further comprising the step of providing the control device to take up an area that it is not larger than an area needed to receive the at least one support device.

5. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body element and thereby defining the penetration distance into said at least one support device by said body element;

measuring the penetration distance, with said measuring means, the measuring means comprising a metal film, associated with a variable thickness spacer element having a top surface and a bottom surface, and an impedance-varying element whose position is fixed and which is located substantially opposite said metal film under the bottom surface of the variable thickness spacer element, the measuring means generating an electric signal as a function of the penetration distance; and driving the filling and emptying of said at least one chamber with said filling fluid by said filling and emptying means via said inlet and outlet means, respectively, based on regulation from said control device including said control station at least as a action of the electric signal generated by the measuring means.

6. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, and including filling means and emptying means structured to be connected to said inlet and outlet means for said flexible chamber and the control device being structured for driving the filling means and emptying means for filling said at least one flexible chamber with said filling fluid or for emptying said fluid therefrom, said control device further comprising measuring means for measuring a penetration distance into said at least one support device;

penetrating said at least one flexible chamber by said body element and thereby defining the penetration distance into said at least one support device by said body element;

measuring the penetration distance, with said measuring means, the measuring means comprising a metal film, associated with a variable thickness spacer element having a top surface and a bottom surface, and an impedance-varying element whose position is fixed and which is located substantially opposite said metal film under the bottom surface of the variable thickness spacer element, the measuring means generating an electric signal as a function of the penetration distance; and driving the filling and emptying of said at least one chamber with said filling fluid by said filling and emptying means via said inlet and outlet means, respectively, based on regulation from said control device at least as a function of the electric signal generated by the measuring means; and wherein said measuring step comprises the step of shielding any influence from a metal mass situated in a vicinity of a monitoring member by providing a shielding element structured to shield the impedance-varying element.

7. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, and including filling means and emptying means structured to be corrected to said inlet and outlet means for said flexible chamber and the control device being structured for driving the filling means and emptying means for filling said at least one flexible chamber with said filling fluid or for emptying said fluid therefrom, said control device further comprising measuring means for measuring a penetration distance into said at least one support device;

penetrating said at least one flexible chamber by said body element and thereby defining the penetration distance into said at least one support device by said body element;

measuring the penetration distance, with said measuring means, the measuring means comprising a metal film, associated with a variable thickness spacer element having a top surface and a bottom surface, and an impedance-varying element whose position is fixed and which is located substantially opposite said metal film under the bottom surface of the variable thickness spacer element, the measuring means generating an electric signal as a function of the penetration distance; and driving the filling and emptying of said at least one chamber wit said filling fluid by said filling and emptying means via said inlet and outlet means, respectively, based on regulation from said control device at least as a function of the electric signal generated by the measuring means; and further comprising disposing the spacer element of variable thickness on a spacer element of fixed thickness.

8. The method of claim 7, wherein said measuring step comprises the step of shielding any influence from a metal mass situated in a vicinity of a monitoring member by providing a shielding element structured to shield said impedance-varying element, said impedance-varying element being interposed between the variable thickness spacer element and the fixed thickness spacer element.

9. A method of supporting a body of a patient for preventing or treating bedsores, comprising:

providing at least one support device comprising a mattress having at least one closed or controlled-release flexible chamber located between a top face for receiving the body and a bottom face;

providing inlet and outlet moans via which a filling fluid can be fed into said chamber or removed therefrom;

providing a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body and thereby defining the penetration distance into said at least one support device by said body;

measuring the penetration distance with said measuring means of said control device; and driving the filling and emptying of said at least one chamber with said filling fluid by said filling and emptying means via said inlet and outlet means, respectively, based on regulation from said control device including said control station at least as a function as the measured penetration distance.

10. An apparatus for supporting a body element, comprising:

at least one support device comprising at least one closed or controlled-release flexible chamber located between a top face for receiving the body element and a bottom face, said flexible chamber being provided with inlet and outlet means via which a filling fluid can be fed into said chamber or removed therefrom; and a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, as a result of having said body element penetrating said at least one flexible chamber, said measuring means being connected to the control station included in said control device;

said control device controlling, at least as a function of the measured penetration distance, said filling and emptying means to fill or empty said at least one chamber with said filling fluid via said inlet and outlet means, respectively.

11. The apparatus of claim 10, wherein the body element is horizontally positioned on said top face of the support device which comprises a prevention or treatment surface.

12. The apparatus of claim 10, wherein the control device takes up an area not larger than an area needed to receive the at least one support device.

13. An apparatus for supporting a body element, comprising:

at least one support device comprising at least one closed or controlled-release flexible chamber located between a top face for receiving the body element and a bottom face, said flexible chamber being provided with inlet and outlet means via which a filling fluid can be fed into said chamber or removed therefrom; and a control device, separate and independent from said at least one support device, the control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device as a result of having said body element penetrating said at least one flexible chamber, said measuring means being connected to the control station included in said control device, said control device including said control station controlling, at least as a function of the measured penetration distance, said filling and emptying means to fill or empty said at least one chamber with said filling fluid via said inlet and outlet means, respectively, the support device being incorporated in an individual support cover, and the entire independent control device being incorporated as a unit in a second independent individual control cover, the independent control device in the second independent control cover being coupled to the support device in the individual support cover via coupling means enabling the control device to cause the filling and emptying means in the independent control device to fill or remove fluid via the inlet and outlet means of said flexible chamber of said support device to cause the filling fluid to be fed into the chamber of the support device or to be removed therefrom.

14. An apparatus for supporting a body element, comprising:

at least one support device comprising at least one flexible closed or controlled-release chamber located between a top face for receiving the body element and a bottom face, said flexible chamber being provided with inlet and outlet means via which a filling fluid can be fed into said chamber or removed therefrom; and a control device, separate and independent from said at least one support device, said control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means comprising a metal film, associated with a variable thickness spacer element having a top surface and a bottom surface, and an impedance-varying element whose position is fixed and which is located substantially opposite said metal film under the bottom surface of the variable thickness spacer element, said measuring means generating an electric signal as a function of the penetration distance, said measuring means being connected for delivery of said electrical signal to the control station included in said control device;

said control device including said control station controlling, at least as a function of the electric signal generated by said measuring means, filling and emptying said at least one chamber with said filling fluid by said filling and emptying means via said inlet and outlet means, respectively.

15. The apparatus of claim 14, wherein the body element is horizontally positioned on said top face of the support device which comprises a prevention or treatment surface.

16. The apparatus of claim 14, wherein the control device takes up an area not larger than an area needed to receive the support device.

17. An apparatus for supporting a body element, comprising:

at least one support device comprising at least one flexible closed or controlled-release chamber located between a top face for receiving the body element and a bottom face, said flexible chamber being provided with inlet and outlet means via which a filling fluid can be fed into said chamber or removed therefrom; and a control device, separate and independent from said at least one support device, said control device having a top face in contact with said bottom face of said at least one support device and a bottom face separated by lateral faces from the top face and including filling means and emptying means structured to be connected to said inlet and outlet means for said flexible chamber and the control device being structured for driving the filling means and emptying means for filling said at least one flexible chamber with said filling fluid or for emptying said fluid therefrom, said control device further comprising measuring means for measuring a penetration distance into said at least one support device, said measuring means comprising a metal film, associated with a variable thickness spacer element having a top surface and a bottom surface, and an impedance-varying element whose position is fixed and which is located substantially opposite said metal film under the bottom surface of the variable thickness spacer element, said measuring means generating an electric signal as a function of the penetration distance;

said control device controlling, at least as a function of the electric signal generated by said measuring means, filling and emptying said at least one chamber with said filling fluid by said filling and emptying means via said inlet and outlet means, respectively, and further comprising a shielding element structured to shield the impedance-varying element from any influence of a metal mass in the vicinity of a monitoring member.

18. An apparatus for supporting a body element, comprising:

at least one support device comprising at least one flexible closed or controlled-release chamber located between a top face for receiving the body element and a bottom face, said flexible chamber being provided with inlet and outlet means via which a filling fluid can be fed into said chamber or removed therefrom; and a control device, separate and independent from said at least one support device, said control device having a top face in contact with said bottom face of said at least one support device and a bottom face separated by lateral faces from the top face and including filling means and emptying means structured to be connected to said inlet and outlet means for said flexible chamber and the control device being structured for driving the filling means and emptying means for filling said at least one flexible chamber with said filling fluid or for emptying said fluid therefrom, said control device further comprising measuring means for measuring a penetration distance into said at least one support device, said measuring means comprising a metal film, associated with a variable thickness spacer element having a top surface and a bottom surface, and an impedance-varying element whose position is fixed and which is located substantially opposite said metal film under the bottom surface of the variable thickness spacer element, said measuring means generating an electric signal as a function of the penetration distance;

said control device controlling, at least as a function of the electric signal generated by said measuring means, filling and emptying said at least one chamber with said filling fluid by said filling and emptying means via said inlet and outlet means, respectively, and the spacer element of variable thickness is disposed on a spacer element of fixed thickness.

19. The apparatus of claim 18, further comprising a shielding element structured to shield said impedance-varying element from any influence from a metal mass situated in vicinity of a monitoring member, said impedance-varying element being interposed between the variable thickness spacer element and the fixed thickness spacer element.

20. An apparatus for supporting a body element, comprising:

at least one support device comprising at least one closed or controlled-release flexible chamber located between a top face for receiving the body element and a bottom face, said flexible chamber being provided with inlet and outlet means via which a filling fluid can be fed into said chamber or removed therefrom; and a control device, separate and independent from said at least one support device, said control device having a top face in contact with said bottom face of said at least one support device and a bottom face separated by lateral faces from the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefor, the measuring means measuring a penetration distance into said at least one support device, said measuring means comprising a metal film, associated with a variable thickness spacer element comprising a top surface and a bottom surface, and an impedance-varying element whose position is fixed, and which is located substantially opposite said metal film, under the bottom surface of the variable thickness spacer element, said measuring means being thereby capable of generating an electric signal as a function of the penetration distance, said measuring means being connected to the control station included in said control device, said control station being structured for driving said filling means and emptying means, said control device including said control station controlling, at least as a function of the electric signal generated by said measuring means, filling and emptying said at least one chamber with said filling fluid by said filling and emptying means via said inlet and outlet means, respectively, the support device being incorporated in an individual support cover, and the entire independent control device being incorporated as a unit in a second independent individual control cover, the independent control device in the second independent control cover being coupled to the support device in the individual support cover via coupling means enabling the control device to cause the filling and emptying means in the independent control device to fill or remove fluid via the inlet and outlet means of said flexible chamber of said support device to cause the filling fluid to be fed into the chamber of the support device or to be removed therefrom.

21. An apparatus for supporting a body of a patient, comprising:

at least one support device comprising a mattress having at least one closed or controlled-release flexible chamber located between a top face for receiving the body and a bottom face, said flexible chamber being provided with inlet and outlet means via which a filling fluid can be fed into said chamber or removed therefrom; and a control device, separate and independent from said at least one support device, said control device having a top face in contact with said bottom face of said at least one support device and a bottom face separated by lateral faces tom the top face of the control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for diving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

said control device including said control station controlling, at least as a function of the penetration distance, said filling and emptying means to fill or empty said at least one chamber with said filling fluid by said filling and emptying means via said inlet and outlet means, respectively, thereby preventing or treating bedsores.

22. The apparatus of claim 21, wherein the support device is incorporated in an individual support cover, and the independent control device is incorporated in a second independent individual control cover, the independent control device in the second independent control cover being coupled to the support device in the individual support cover via coupling means enabling the control device to cause the filling and emptying means in the independent control device to fill or remove fluid via the inlet and outlet means of said flexible chamber of said support device to cause the filling fluid to be fed into the chamber of the support device or to be removed therefrom.

23. A method of supporting a body element, comprising:

providing at least one support device comprising at least one closed or controlled-release flexible chamber located between a top face for receiving the body element and a bottom face;

providing said flexible chamber with inlet and outlet means via which a filling fluid can be fed into said chamber or removed therefrom;

providing a control device, separate and independent from said at least one support devices, the control device having a top face in contact with said bottom face of said at least one support device and a bottom face separated by lateral faces from the top face of said control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body element and thereby defining the penetration distance into said at least one support device by said body element;

measuring the penetration distance, with said measuring means, said measuring means comprising a metal film, associated whit a variable thickness spacer element comprising a top surface and a bottom surface, and an impedance-varying element whose position is fixed and which is located substantially opposite from said metal film under the bottom surface of the variable thickness spacer element, said measuring means being thereby capable of generating an electric signal as a function of the penetration distance;

driving the filling and emptying of said at least one chamber with said filling fluid by said filling and emptying means via said inlet and outlet means, respectively, based on regulation from said control device including said control station at least as a function of the electric signal generated by said measuring means;

incorporating the support device into an individual support cover;

incorporating the entire independent control device as a unit into a second independent individual control cover; and coupling the independent control device in the second independent control cover to the support device in the individual support cover via coupling means enabling the control device to cause the filling and emptying means in the independent control device to fill or remove fluid via the inlet and outlet means of said flexible chamber of said support device to cause the filling fluid to be fed into the chamber of the support device or to be removed therefrom.

24. A method for supporting a body of a patient for preventing or treating bedsores, said method comprising:

providing at least one support device comprising a mattress comprising at least one closed or controlled-release flexible chamber located between a top face for receiving the body and a bottom face;

providing inlet and outlet means via which a filling fluid can be fed into said chamber or removed therefrom;

providing a control device, separate and independent from said at least one support device, said control device having a top face in contact with said bottom face of said at least one support device and a bottom face separated by lateral faces from the top face of said control device, the control device defining an internal control chamber, the control device comprising located internally within said control chamber all of a control station, filling means, emptying means, and a monitoring member comprising measuring means, the filling means and emptying means being structured to be connected to said inlet and outlet means for said flexible chamber, and said control station being structured for driving the filling means and the emptying means included in said control device for filling said at least one flexible chamber with said filling fluid or for emptying said fluid therefrom, the measuring means measuring a penetration distance into said at least one support device, said measuring means being connected to the control station included in said control device;

penetrating said at least one flexible chamber by said body element and thereby defining the penetration distance into said at least one support device by said body element, measuring the penetration distance with said measuring means of said control device;

driving the filling and emptying of said at least one chamber with said filling fluid by said filling and emptying means via said inlet and outlet means, respectively, based on regulation from said control device including said control station at least as a function as the measured penetration distance;

incorporating the support device into an individual support cover;

incorporating the entire independent control device as a unit into a second independent individual control cover; and coupling the independent control device in the second independent control cover to the support device in the individual support cover via coupling means enabling the control device to cause the filling and emptying means in the independent control device to fill or remove fluid via the inlet and outlet means of said flexible chamber of said support device to cause the filling fluid to be fed into the chamber of he support dice or to be removed therefrom.

* * * * *